United States Patent [19]

Itoh et al.

[11] 4,123,770

[45] Oct. 31, 1978

[54] PROCESS AND APPARATUS FOR DEVELOPING PHOTOGRAPHS

[76] Inventors: Shiuta Itoh; Masuko Itoh, both of No. 16-43, 3-chome, Horinouchi, Suginami-ku, Tokyo; Masato Kitaura, No. 33-10, 1-chome, Zoushigaya, Toshima-ku, Tokyo, all of Japan

[21] Appl. No.: 723,541

[22] Filed: Sep. 15, 1976

[30] Foreign Application Priority Data

Oct. 2, 1975 [JP] Japan ..... 50-119150

[51] Int. Cl.[2] ..... G03D 13/08

[52] U.S. Cl. ..... 354/337; 354/328; 354/341

[58] Field of Search ..... 354/312, 313, 328, 329, 354/337, 340, 341, 343, 344

[56] References Cited

U.S. PATENT DOCUMENTS

| | | | |
|---|---|---|---|
| 1,924,944 | 8/1933 | Kittredge | 354/340 |
| 2,344,998 | 3/1944 | Morgan et al. | 354/341 |
| 2,484,341 | 10/1949 | Grover | 354/341 |
| 3,726,201 | 4/1973 | Berchtold | 354/340 |
| 4,001,852 | 1/1977 | Gall | 354/313 |
| 4,016,585 | 4/1977 | Chapman | 354/341 |

FOREIGN PATENT DOCUMENTS

| | | | |
|---|---|---|---|
| 655,094 | 10/1964 | Belgium | 354/340 |
| 462,971 | 2/1950 | Canada | 354/341 |
| 247,139 | 6/1925 | United Kingdom | 354/340 |

*Primary Examiner*—L. T. Hix
*Assistant Examiner*—Alan Mathews
*Attorney, Agent, or Firm*—Cameron, Kerkam, Sutton, Stowell & Stowell

[57] ABSTRACT

A process and apparatus for developing photographs is provided wherein photographic sensitive material is held in a holding frame. The sensitive material is soaked in a developing solution by positioning the holding frame in a development tank with its upper and lower end faces spaced with predetermined distances, preferably more than 10 millimeters, apart respectively from the upper and bottom surfaces of the development tank. Thereafter the position of the development tank is reversed up and down at predetermined times while the developing-out of the sensitive material is carried out.

5 Claims, 6 Drawing Figures

PROCESS AND APPARATUS FOR DEVELOPING PHOTOGRAPHS

BACKGROUND OF THE INVENTION

The present invention relates to an improvement of a developing process of photographic materials such as photographic film, roll films, sheet films, photographic plates, photographic papers or the like.

The purpose of this invention is to solve the problem of poor uniformity in development to be formed, at the time of the developing process, on the sensitive materials namely on the opposite marginal areas of roll films and other photographic materials placed especially close to the top and/or bottom of development tanks.

For the above purpose the films are placed in the development tanks allowing spaces between the films and the top and/or bottom of the tanks in the course of the developing process.

Such poor uniformity in development is classified mainly into two kinds, one which has cloud-like patterns over the surface of the photographic materials and the other has narrow strip-like patterns at the opposite marginal areas of the photographic materials.

The formation of the former may be effectively prevented by sufficient agitation of the photographic materials for about 30 seconds at the beginning of developing process in a development tank, which treatment has been broadly employed in the current photographic development process. It has not been successful, however, to prevent the formation of the latter, narrow strip-like patterns, as the cause has not been found out.

The inventors of the present invention tried to find out the causes of the strip-like patterns by carrying out many tests. The developing is usually carried out by shaking the development tank as soon as the photographic sensitive materials have been placed in the tank and sufficient developing solution has been poured into the tank to wholly submerge the materials in the solution.

Thus, the photographic materials are exposed to the developing solution which flows upwardly and downwardly on the surface of the materials as a result of the shaking of the tank. Contrary to the above procedure, the inventors made an attempt to place the photographic materials supported on a holding frame into the tank already filled with the developing solution and then repeatedly move the holding frame to the bottom of the development tank. As the result of this attempt, it was found that the narrow strip-like patterns come out only in the downward marginal areas of the materials.

From this, it was found that such poor uniformity in development is caused by the vortical flow of the developing solution in contact with the surface of the materials which has been generated as the solution is pushed or carried by the downward movement of the holding frame or the materials as the frame hits the bottom of the tank and rebounds.

Essentially, the development advances more quickly when the contact of the developing solution with the photographic sensitive materials is active and, on the other hand, it becomes slow when the contact between the flow of developing solution and the photographic sensitive materials is less active. Thus, the poor uniformity is caused when the contact due to flow of the developing solution over the surface of the sensitive materials is not uniform.

It was also found out that the vortex flow of developing solution exists only in a zone of constant height from the bottom of the tank — usually 10 to 25 millimeters. Therefore, uniform development of a sensitive material is expected if the placement of the material in this zone is avoided, or if a space of 10 to 25 millimeters is kept between the material and the bottom (and the top) of the tank during its reversing motion in the process of the development.

SUMMARY OF THE INVENTION

Accordingly, the present invention is aimed to provide a process of the uniform development of photographic sensitive materials so as to provide finished photographs with no developing marks due to poor uniformity of development.

According to the present invention, there is provided a process of developing photographs comprising the steps of holding photographic sensitive materials in a holding framework, soaking the sensitive materials in developing solution by positioning the holding framework in a development tank with its upper and lower end faces spaced with predetermined distances, preferably more than 10 millimeters apart respectively from the upper and bottom inner surfaces of the development tank, and reversing the development tank up and down at predetermined times while the developing-out of the photographic sensitive materials is carried out and apparatus for effecting the above steps.

The object of the present invention is to provide a highly improved process and apparatus for developing photographs which provide uniformly developed photographs entirely free of developing marks due to poor uniformity development, specifically the uniform photographs free of narrow striplike developing marks on the marginal side areas of the photographic sensitive materials which is moved upwardly and downwardly in a repeated manner while treated in a development tank and which side areas corresponding to the longitudinal opposite sides in case of roll films.

BRIEF DESCRIPTION OF ATTACHED DRAWINGS

DESCRIPTION OF PREFERRED EMBODIMENTS OF THE INVENTION

Preferred embodiments of an apparatus for carrying out the process of developing photographs according to the present invention will be described in detail with reference to the attached drawings.

Figure 1:
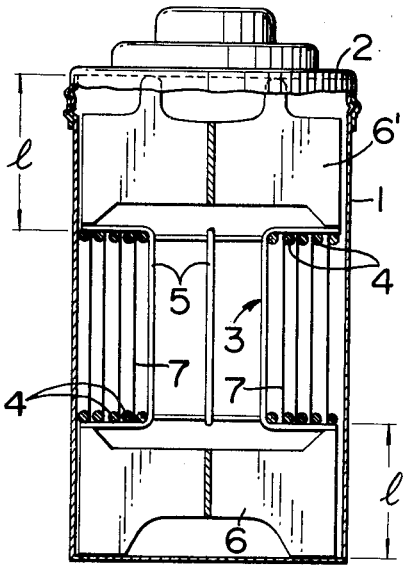
FIG. 1 is a longitudinal section of a development tank for use in carrying out a process of developing photographs in accordance with the present invention.

In FIG. 1, the reference numeral 1 indicates a small sized development tank having at its upper end an opening for supplying therethrough developing solution, the opening being closed in liquid tight manner by a cap 2 to enable the shaking or reversing motion of the tank 1 up and down. A film holding framework 3 is provided with two guide members 4 each made of a continuous wire formed circinately in a horizontal plane and a frame body 5 for supporting the guide members.

In the tank 1 there are disposed a lower spacer 6 and an upper spacer 6' to provide a required space 1 between the lower end of the framework and the bottom surface of the tank and also between the upper end of the framework and the upper surface of the tank perspectively. On the framework 3 are mounted photographic films 7 wound around the circinate spaces formed by the upper end lower guide members 4 of the framework. After disposing in turn the lower spacer 6, the framework 3 with photographic films 7 and the upper spacer 6' in stuck relation within the tank 1, the upper opening of the tank is closed by a cap 2 in liquid tight manner. Then, there is supplied through an inlet port of the cap 2 a required amount of developing solution sufficient to submerge the whole portion of the framework 3 and the photographic films mounted thereon, and thereafter the inlet port is closed in liquid tight manner.

While developing the films 7 (photographic sensitive material), the development tank 1 is repeatedly reversed up and down at required times, and, preferably a shaking motion is added to the tank while the tank reversed up and down.

Figure 2:
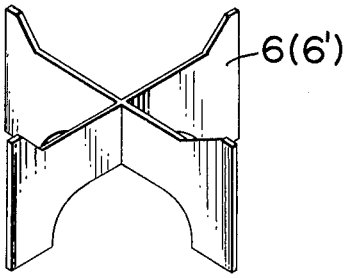
FIG. 2 is a perspective view of spacers for use in the tank of FIG. 1.

The spacers 6 and 6' as shown in FIG. 2 are formed of cross-like thin plates and each has a height of about 10 to 25 millimeters sufficient to keep the film free from the vortex flow of developing solution which will be generated when the tank is reversed up and down.

The height of the spacers 6 and 6' may be more than that specified above, but since higher spacers cause an increase in the volume of the tank 1 was to require a greater amount of developing solution than would otherwise be used, the height of the spacers 6 and 6' is suggested to be limited to the above value from the economical view point. Thus, by use of spacers 6 and 6' the poor uniformity in development of the materials caused by the vortex flow of the developing solution is effectively eliminated.

Figure 3:
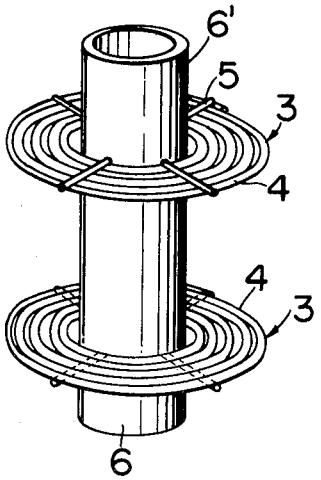
FIG. 3 is a perspective view of another embodiment of film holding frame for use in carrying out a process of the present invention.

FIG. 3 is to show a different form of the spacers 6 and 6' and the frame body 5, in which the upper and lower spacers 6 and 6' are integrally formed with the framework 3 and includes a tubular member, the upper and lower extremities of which serve as the spacers.

Figure 4:
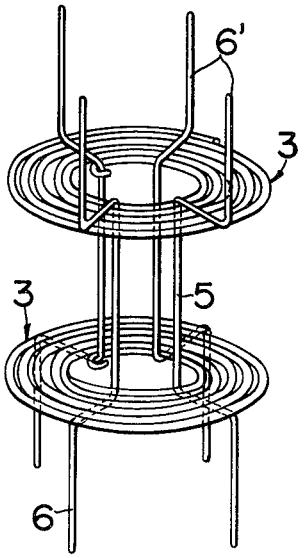
FIG. 4 is a perspective view of a further embodiment of film holding frame for use in carrying out a process of the present invention.

FIG. 4 is to show another different form of the spacers 6 and 6' in which they are integrally formed by the upwardly and downwardly angulated portions of the frame body 5 having a required length corresponding to 1 in FIG. 1. The frame body 5 is made up of shaped multiple rod members with the lower and/or upper spacer being formed by three or four leg-like members projecting downwardly or upwardly, as the case may be, from the holding frame.

Further varieties of the spacers 6 and 6' may be easily contemplated by those skilled in the same art. For example, the spacers's 6 and 6' may be formed of some projecting portions (not shown) integral with the upper and/or lower surface of the tank 1.

Figure 5:
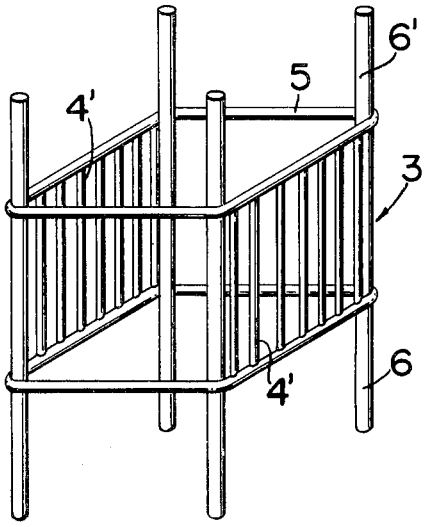
FIG. 5 is a perspective view of a still further embodiment of film holding frame for use in a process of the present invention.

FIG. 5 is to show a different form of the framework 3 which is specifically adapted for use of the development of sheet films or photographic papers. This form of framework 3 has an upper and lower rectangular frame members which are horizontally positioned and rigidly connected at their four corners by vertically extending strut members, which strut members forming the upper and lower spacers 6 and 6' at their opposite end portions projecting beyond rectangular frame members 5 and 5'.

Between the upper and lower frame members 5 there are provided a plurality of vertical guide members 4' arranged at desired intervals, which vertical guide members being disposed over one pair of interfacing sides of the frame members 5 as seen in FIG. 5.

Vertical slot-like spaces formed between the adjacent vertical guide members 5 are used to support sheet-like photographic sensitive materials (not shown) by passing the sensitive materials therethrough while the development of the same processed.

As may be understood from the above descriptions the present invention provides an improved process for developing out photographs on photographic sensitive materials. It provides the finished negative plates free of developing marks due to poor uniformity in development by means of simple apparatus in a simple and easy operation.

Figure 6:
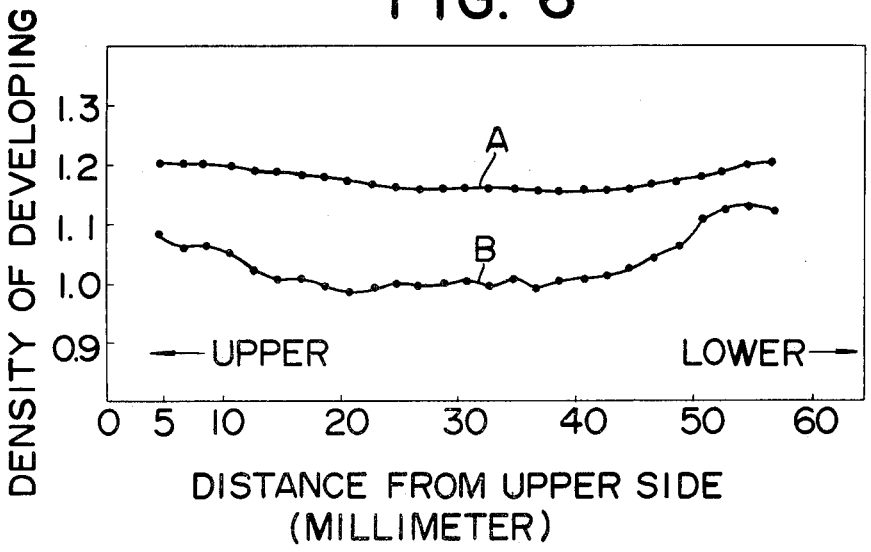
FIG. 6 is a diagram showing typical characteristic curves of the plotted densities of the developed material obtained by a process of the present invention and the prior art process.

FIG. 6 is a diagram to show a comparison of the uniformities of the development obtained by the present invention and by the prior art. The abscissa of the diagram indicates the distance from the upper side downwardly acrossing the width of the film, and the vertical coodinate indicates the density of the development. The curve A shows the plotted densities of the developed material when processed in accordance with the present invention, while the curve B shows those when processed in accordance with the prior art.

As seen from the two curves of FIG. 6, in accordance with the present invention there could be obtained a much more uniform developing-out of photographs all over a photographic sensitive material as compared with that of the prior art. Therefore, successive treatments such as fixation for finishing photographs may be carried out in much easier operations thereby producing photographs of better quality than those by the prior art.

We claim:

1. Apparatus for developing photographs comprising a development tank having an open upper end to be closed by a cap member after filled with developing solution, a film holding framework having two film guide members disposed vertically spaced with each other and adapted to hold a photographic sensitive film in the vertical position and a frame body for supporting the film guide members, a lower spacer disposed at the lower end of the tank for spacing the film on the film holding frame apart from the lower inside surface of the development tank at a distance of at least 10 millimeters, and an upper spacer for spacing the film apart from the upper inside surface of the development tank at a distance of at least 10 millimeters, said lower and said upper spacer being formed of cross-like thin plates vertically positioned and having a height of at least 10 millimeters, said film holding frame and said lower and upper spaces having no substantial obstacle in the vertical flow path for the solution leading to the film surfaces and being capable of providing substantially laminar flow of the solution over the film surfaces.

2. Apparatus for developing photographs comprising a development tank having an open upper end to be closed by a cap member after filled with developing solution, a film holding framework having two film guide members disposed vertically spaced with each other and adapted to hold a photographic sensitive film in the vertical position and a frame body for supporting the film guide members, a lower spacer disposed at the lower end of the tank for spacing the film on the film holding frame apart from the lower inside surface of the development tank at a distance of at least 10 millimeters, and an upper spacer for spacing the film apart from the upper inside surface of the development tank at a distance of at least 10 millimeters, each lower and upper spacer being formed by at least three leg-like wire members vertically projecting from the film holding frame.

3. Apparatus for developing photographs comprising a developing tank having an open upper end to be closed by a cap member after filled with developing solution, a film holding framework having two film guide members disposed vertically spaced with each other and adapted to hold a photographic sensitive film in the vertical position and a frame body for supporting the film guide members, a lower spacer disposed at the lower end of the tank for spacing the film on the film holding frame apart from the lower inside surface of the development tank at a distance of at least 10 millimeters, and an upper spacer for spacing the film apart from the upper inside surface of the development tank at a distance of at least 10 millimeters, said film holding frame and said lower and upper spaces having no substantial obstacle in the vertical flow paths for the solution leading to the film surface and being capable of providing substantially laminar flow of the solution over the film surface, said film holding framework including upper and lower rectangular frame members horizontally positioned and rigidly connected at the four corners by vertically extending strut members, the lower and the upper spacers being formed by the opposite end portions of the strut members projecting beyond the rectangular frame members, and said first holding framework including a plurality of wire members vertically extending between the upper and the lower rectangular frame members symmetrically arranged at the opposite ends with respect to a vertical plane passing through the center of the film holding framework.

4. Apparatus for developing photographs comprising a development tank having an open upper end to be closed by a cap member after filled with developing solution, a film holding framework having two film guide members disposed vertically spaced with each other and adapted to hold a photographic sensitive film in the vertical position and a frame body for supporting the film guide members, a lower spacer disposed at the lower end of the tank for spacing the film on the film holding frame apart from the lower inside surface of the development tank at a distance of at least 10 millimeters, and an upper spacer for spacing the film apart from the upper inside surface of the development tank at a distance of at least 10 millimeters, said film holding frame and said lower and upper spaces having no substantial obstacle in the vertical flow paths for the solution leading to the film surfaces and being capable of providing substantially laminar flow of the solution over the film surfaces, said film guide members respectively being formed of continuous wires formed circinate in horizontal planes, said circinate film guide members each including an open center section and the lower and upper spacers being formed integral with the frame body which passes through said open center sections.

5. An apparatus as defined in claim 4 wherein said frame body comprises at least three members and said lower and said upper spacers are formed by the ends of said rod members vertically projecting beyond the film guide members.

* * * * *